US008176977B2

(12) United States Patent
Keller

(10) Patent No.: US 8,176,977 B2
(45) Date of Patent: May 15, 2012

(54) METHOD FOR RAPID SEALING OF BOREHOLES

(76) Inventor: Carl E. Keller, Santa Fe, NM (US)

( * ) Notice: Subject to any disclaimer, the term of this patent is extended or adjusted under 35 U.S.C. 154(b) by 449 days.

(21) Appl. No.: 12/380,228

(22) Filed: Feb. 25, 2009

(65) Prior Publication Data

US 2009/0211765 A1 Aug. 27, 2009

Related U.S. Application Data

(60) Provisional application No. 61/066,935, filed on Feb. 25, 2008.

(51) Int. Cl.
*E21B 17/00* (2006.01)

(52) U.S. Cl. ..... 166/242.2; 166/384; 166/207; 405/150.1; 405/184

(58) Field of Classification Search ..... 166/387, 166/380, 377, 385, 250.03, 250.15, 250.02, 166/77.1, 85.1; 703/50; 73/152.41, 8, 152.01; 405/146, 150.01; 425/11, 59, 503
See application file for complete search history.

(56) References Cited

U.S. PATENT DOCUMENTS

| | | | | |
|---|---|---|---|---|
| 4,778,553 | A | 10/1988 | Wood | |
| 5,176,207 | A | 1/1993 | Keller | |
| 5,246,862 | A | 9/1993 | Grey et al. | |
| 5,377,754 | A | 1/1995 | Keller | |
| 5,803,666 | A | 9/1998 | Keller | |
| 5,804,743 | A | 9/1998 | Vroblesky et al. | |
| 5,853,049 | A | 12/1998 | Keller | |
| 6,026,900 | A | 2/2000 | Keller | |
| 6,109,828 | A | 8/2000 | Keller | |
| 6,244,846 | B1 | 6/2001 | Keller | |
| 6,283,209 | B1 | 9/2001 | Keller | |
| 6,298,920 | B1 | 10/2001 | Keller | |
| 6,910,374 | B2 | 6/2005 | Keller | |
| 7,281,422 | B2 | 10/2007 | Keller | |
| 7,334,486 | B1 | 2/2008 | Klammler et al. | |
| 2004/0020544 | A1 * | 2/2004 | Kamiyama et al. | 138/98 |
| 2004/0065438 | A1 | 4/2004 | Keller | |
| 2005/0172710 | A1 * | 8/2005 | Keller | 73/152.41 |
| 2007/0260439 | A1 | 11/2007 | Keller | |

OTHER PUBLICATIONS

Keller, C., et al., "Evaluation of the Potential Utility of Fluid Absorber Mapping . . . "; Proc. of the 7th Nat'l Outdoor Action Conf.; May 25, 1993; pp. 421-435; USA.

Keller, C., Improved Spatial Resolution in Vertical and Horizontal Holes . . . ; Remediation of Hazardous Waste Contaminated Soils; 1994; pp. 513-541; Marcel Dekker, Inc.; USA.

Cherry, J. A., et al.; "A New Depth-Discrete Multilevel Monitoring Approach for Fractured Rock"; Ground Water Monit. & Remed.; 2007; pp. 57-70; vol. 27, No. 2; USA.

* cited by examiner

*Primary Examiner* — William P Neuder
*Assistant Examiner* — Yong-Suk Ro
(74) *Attorney, Agent, or Firm* — Rod D. Baker

(57) ABSTRACT

A method and apparatus for rapidly installing or withdrawing a sealing liner into or out of a subsurface well bore or borehole. An eversion aid, such as an open-ended cylinder, is engaged with the liner, the eversion aid serving to push the liner down the borehole during installation, and to assist in proper liner extraction during its withdrawal from the borehole. Water is transferred between the liner interior and the borehole outside the liner to regulate the disposition of borehole water, and to aid in proper sealing functions of the liner and to promote proper liner extraction during withdrawal.

20 Claims, 9 Drawing Sheets

Fig. 8A
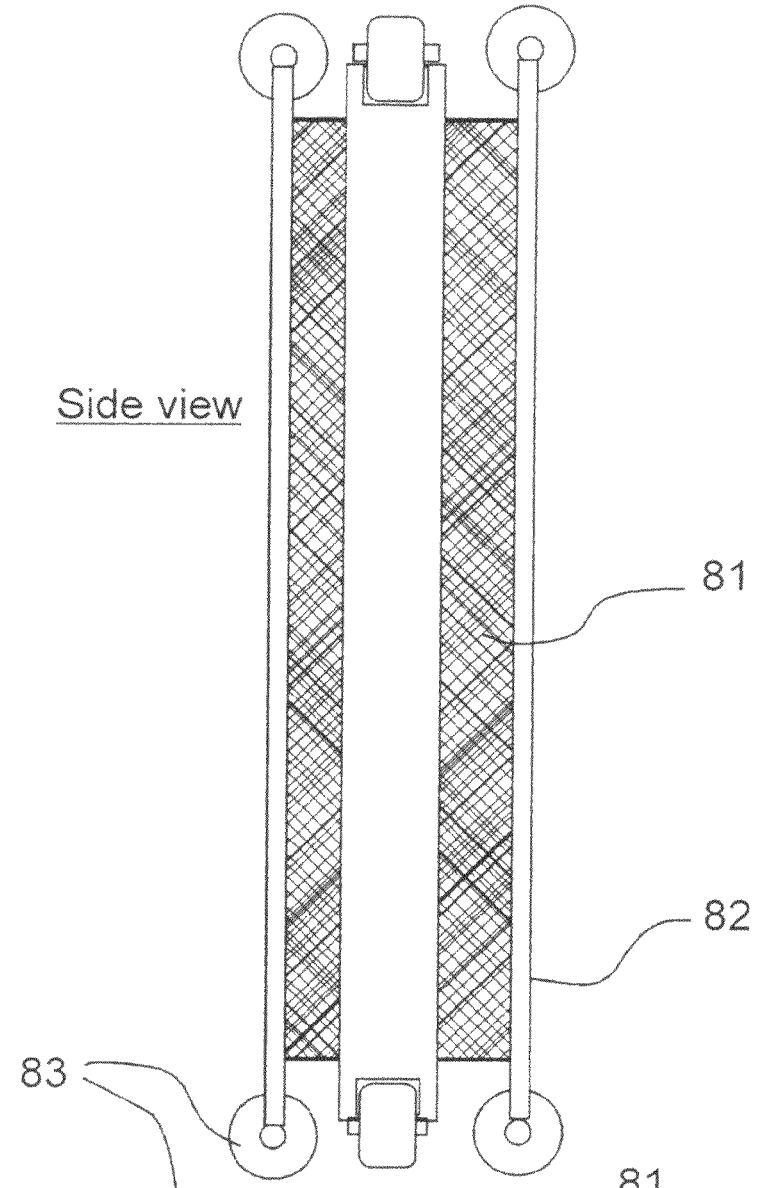
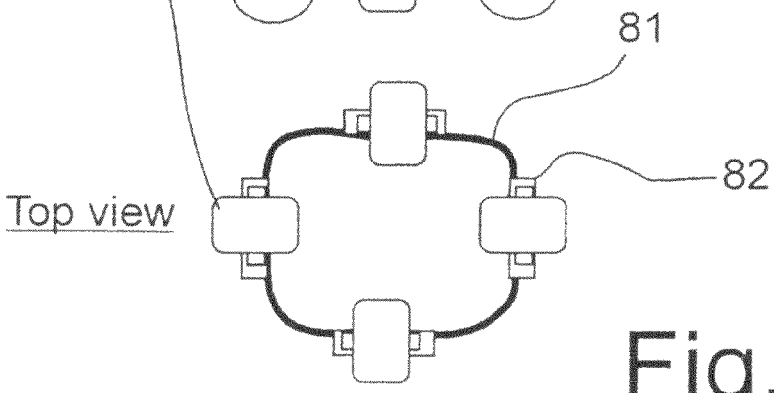
Fig. 8B

Fig. 9A
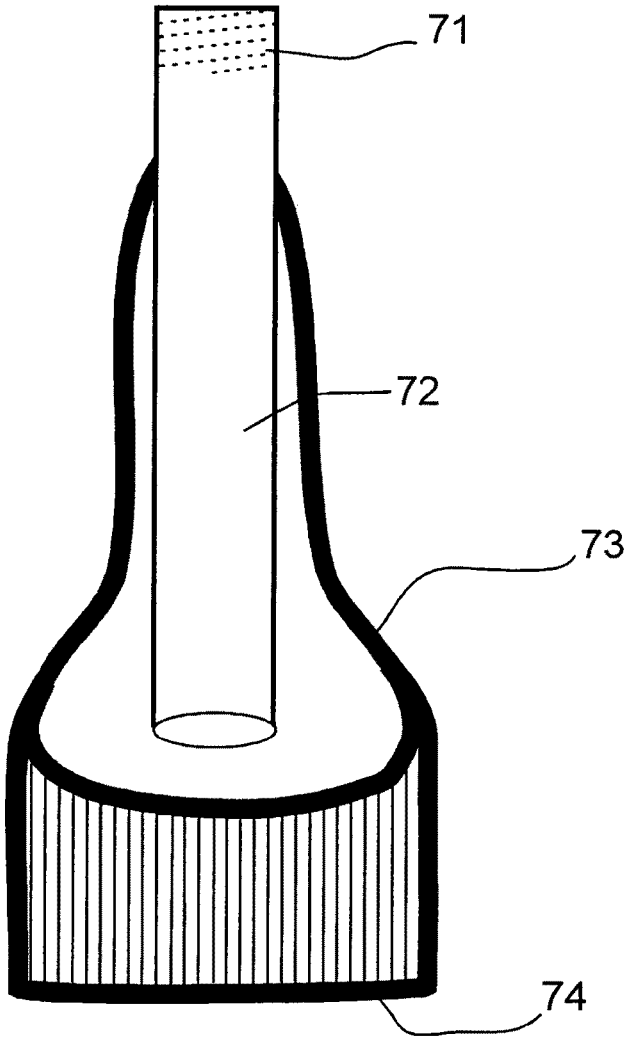
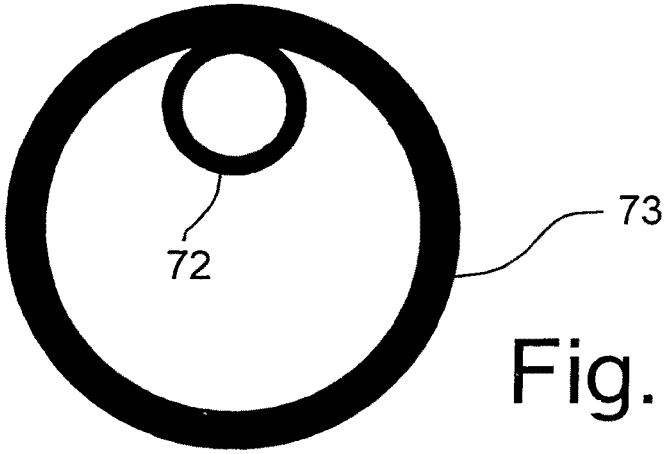
Fig. 9B

METHOD FOR RAPID SEALING OF BOREHOLES

CROSS-REFERENCE TO RELATED APPLICATIONS

This application claims the benefit of the filing of U.S. Provisional Patent Application Ser. No. 61/066,935, entitled Method for Rapid Sealing of Boreholes, filed on Feb. 25, 2008, and the entire specification thereof is incorporated herein by reference.

FIELD OF THE INVENTION

The invention relates to everting borehole liners and, more particularly, to a method for rapid installation of the everting liner without driving the borehole fluids into the geologic formation surrounding the borehole.

BACKGROUND OF THE INVENTION

Flexible borehole liners are installed by the eversion process to seal the borehole against flow into or out of the borehole, which flow can cause the spread of ground water contamination. Helpful and general background regarding the utility and function of everting flexible borehole liners is provided by my previously issued U.S. Pat. Nos. 6,910,374 and 7,281,422, the entire disclosures both of which are incorporated herein by reference. The basic installation method propagates an everting borehole liner into the borehole by adding water to the interior of the everting liner, which dilates the liner and causes the liner to displace the borehole fluids (usually water or air) into the formation as the liner is everted into the borehole. In this basic method, the liner installation rate is controlled by the driving pressure of the water added to the interior of the liner, and by the transmissivity of the media surrounding the borehole, which controls the rate that the borehole water can be displaced into that media.

As the liner propagates by eversion, it sequentially seals each flow path which intersects the borehole, such as a fracture, until all the major fractures have been sealed. As the flow paths are sealed, the liner installation rate decreases until it is propagating very slowly. Further installation of the liner to the bottom of the borehole is not practical because of the slow rate of descent. The typical installation time is at least one to two hours until the liner has nearly stopped, and the removal of the liner by inversion requires a similar time.

The drilling of deep boreholes, for whatever purpose the hole is to be used, often requires more than one day's drilling. A flexible liner is an attractive device to seal a borehole at the end of each day during the drilling process to prevent contaminant migration overnight. However, the liner installation and removal process, as commonly performed, requires far too much time and prolongs the drilling of the borehole. Another major disadvantage of previous liner installation methods is that the contaminated borehole water is forced into the surrounding subsurface formation, where it is absorbed into the pore space of the formation and may contaminate otherwise uncontaminated aquifers. Further, the use of a tube to remove the water from beneath the liner as it is emplaced violates the seal of the liner. Removal of the tube causes the subsequent liner removal by eversion to require several days.

SUMMARY OF THE INVENTION

An object of the presently disclosed apparatus and method is to allow a flexible sealing liner to be rapidly everted into the borehole without forcing the borehole water into the formation. The rapid eversion allows the liner to be emplaced quickly, often in less than one half hour. The presently disclosed apparatus and method also allow the liner to be removed in a similarly desirably short time period. The system and method make it practical to use an everting continuous borehole liner for sealing a borehole whenever the hole-drilling process has been suspended (e.g., each night or weekend) as the borehole is lengthened during the drilling process, using a single liner of fixed length. Contaminated borehole water is conveniently stored inside the liner to dilate the liner and form the seal of the borehole, and therefore does not require storage of contaminated water on the ground surface. As the liner is removed, the borehole water is returned to the borehole. Consequently, the amount of water forced into the formation is minimized.

To achieve the foregoing and other objects, and in accordance with the functions of the system embodied and broadly described herein, the present method includes the use of a heavy cylindrical device which causes the liner to evert as it is lowered into the hole, without the need for the liner to be dilated by an internal pressure greater than the fluid pressure in the borehole. This allows the liner to be everted to the bottom of the hole by a small addition of water pumped from the hole. When the liner has reached the bottom of the hole, a tube is emplaced to the bottom of the liner. Borehole water is pumped from the top end of the borehole and through the tube to the bottom of the liner, causing it to dilate at the bottom end of the hole forcing the water in the annulus, between the liner and the borehole wall, to be displaced upward to the pump which transfers the borehole water into the bottom end of the sealing liner. In this manner, the liner is dilated in the borehole using the borehole water.

When the liner has been filled, the water level in the liner is maintained higher than the water level in the formation to assure a sufficient differential pressure to cause the liner to be urged forcibly against the borehole wall. The urging of the liner against the wall seals the borehole against flow into or out of the borehole.

When the liner is to be removed, a second tube perforated along most of its length is emplaced inside the liner to the bottom of the hole. Water is now pumped from the interior of the liner into the annulus between the liner and the borehole wall. Because the second tube is perforated, it draws water preferentially from the top end of the tube, which is nearer the pump, and therefore from the top end of the liner. However, as the liner tends to contract and to collapse around the upper reaches of the perforated tube as water is withdrawn from inside the top end of the liner, the perforated tube continues to draw from deeper in the liner (where the liner has yet to collapse fully against the perforated tube). This graduated water withdrawal from the liner causes the liner to be emptied from the top downwards.

As the liner water is being pumped into the borehole, a moderate tension is maintained on the inverted liner at the surface, which tends to invert the liner at the bottom end. However, inversion of the liner does not commence until there is sufficient water flow to beneath the dilated bottom end of the liner. At that time, the heavy cylindrical device will form the liner, causing it to invert rather than to buckle. Once the liner is free to invert, it is drawn back to the surface and stored on the shipping reel at the surface for the next installation. Without the heavy cylindrical device, which serves as an "eversion aide," experience has shown that the liner will tend to buckle under the applied tension and to jam in the borehole, making removal difficult and potentially damaging the liner.

The procedure described in detail hereafter depends in part the design of the eversion aid and the method by which the water is pumped into and out of the liner. Additional desirable characteristics of the eversion aid will be described herein.

Additional objects, advantages and novel features of the disclosed apparatus and method will be set forth in part in the description which follows, and in part will become apparent to those skilled in the art upon examination of the following teachings, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate embodiments of the presently disclosed method and apparatus and, together with the description, serve to explain the principles of the invention. In the drawings:

FIG. 8A is an enlarged cross-sectional side view diagram showing the features of yet another alternative desirable embodiment of the eversion aid component of the present apparatus;

FIG. 8B an axial view, e.g., from above, of the embodiment of the eversion aide component depicted in FIG. 8A;

FIG. 9A is an enlarged cross-sectional side view diagram showing the features of still another alternative desirable embodiment of the eversion aid component of the present apparatus; and FIG. 9B an axial view, e.g., from below, of the embodiment of the eversion aide component depicted in FIG. 9A.

Like numerals are used to denote like elements throughout the several views.

DETAILED DESCRIPTION

Figure 1:
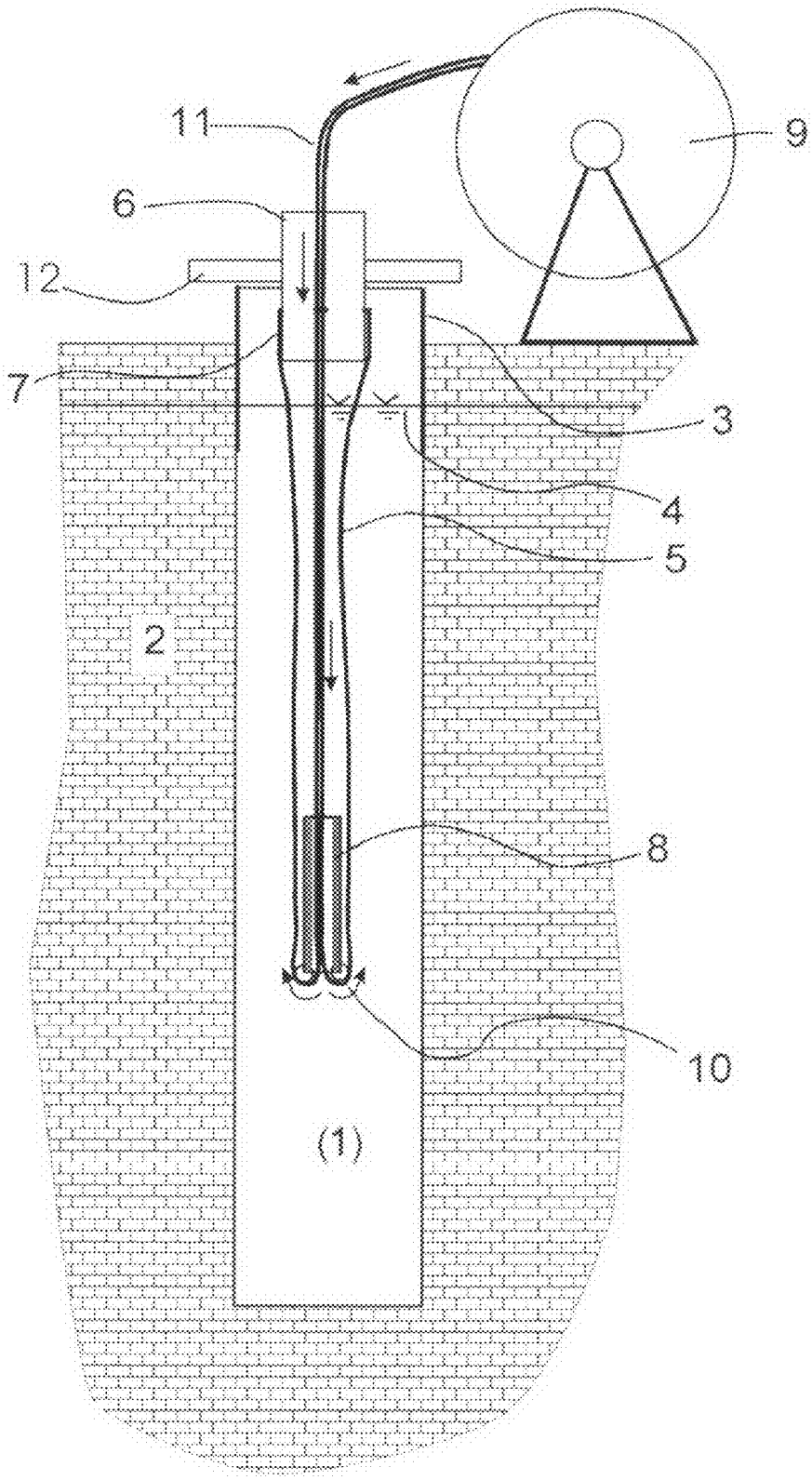
FIG. 1 is a cross-sectional side view diagram (not to scale) showing the eversion of a liner down into a borehole with the eversion aid component pushing the liner down the hole, all according to the present disclosure.

In accordance with the present disclosure and referring generally to FIG. 1, an open and stable borehole 1 is drilled conventionally into a geologic formation 2. A pipe, serving as a surface casing 3, is set in the borehole 1. The water level 4 in the borehole is at the elevation shown by example in FIG. 1, and corresponds approximately to the ambient water table. A flexible tubular liner 5 (made, for example, of a urethane coated nylon fabric and slightly larger in diameter than the borehole) is attached to a short section of top pipe 6 by a clamp 7 or equivalent attachment device. The distal end of the liner thus is held and maintained at or near the top of the borehole 1. The top pipe 6 is supported, for example, by a cross member 12 spanning the top of the casing 3.

Inside the liner 5 is disposed an eversion aid 8 component, the eversion aid preferably being an open-ended cylinder formed of a heavy composite, as described further hereafter, or other weighty material. The eversion aid 8 is disposed in the liner 5 by passing the free or distal end of the liner 5 first through the top pipe 6 and then through the open interior of the eversion aid 8 and then folding the distal end of the liner 5 over the eversion aid 8, thus forming a cuff which is secured around the lower end of the pipe 6 by the clamp 7 or the like. On the ground's surface, the liner 5 is stored at on the reel 9 to be paid out as needed. The apparatus configuration thus is shown in FIG. 1. In such geometry, the eversion aid 8 weighs heavily on the interior of the lower-most portion of the liner 5. The lower-most point 10 of the inverted liner 5 is called the eversion point.

Figure 2:
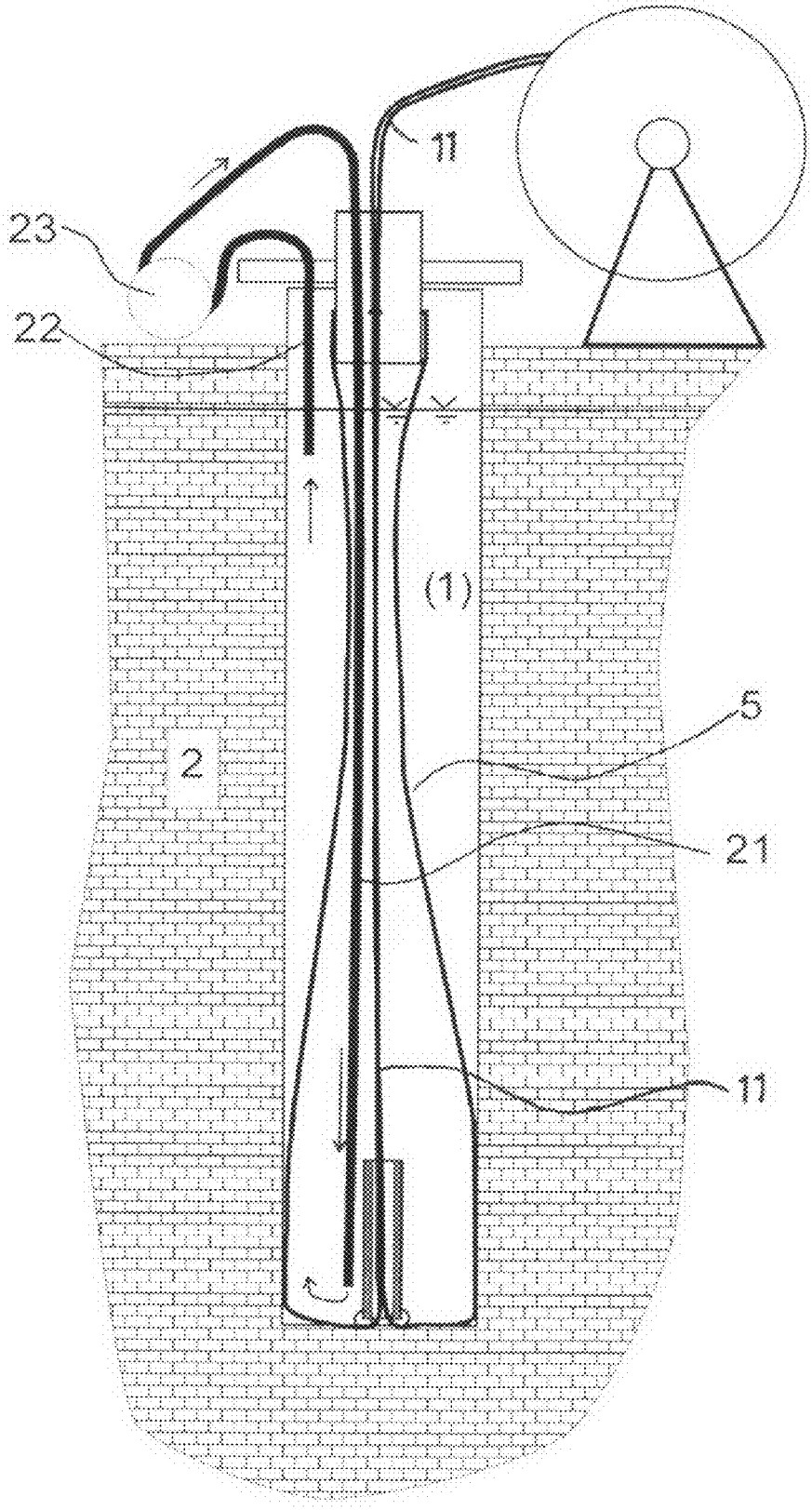
FIG. 2 is a cross-sectional side view diagram showing a pump, first injection tube and second extraction tube used to dilate the liner, and with the eversion aid situated at the bottom of the borehole.

It is seen, therefore, that the liner in condition for rapid installation or extraction has an inverted portion 11 (that is "right-side-in") and an everted portion 5 (that is "inside-out") as shown generally in FIGS. 1 and 2. The eversion point (actually an annular fold) 10, where the liner is bent or folded around the bottom edge of the eversion aid 8, defines the transition from the inverted portion 11 to the everted portion 5. The liner where it is folded moves past the bottom edge of the eversion aid 8 when the eversion aid is moving in the borehole 1 as described herein. When the liner is being installed, the liner moves (e.g., slidably or upon rollers) radially outward past the bottom edge of the eversion aid 8 while the eversion aid descends the borehole 1, as indicated by the directional arrows of FIG. 1. Conversely, while the liner is being extracted, the eversion aid ascends the borehole, and the liner (at its "inversion point") moves radially inward past the bottom edge of the eversion aid.

During liner installation, due at least in part to the downward force (weight) of the eversion aid 8 on the liner 5 at the eversion point 10, the liner is pulled from the rotatable reel 9. The inverted liner 11 passes downward through the top pipe 6 and through the eversion aid 8. As the inverted liner 11 is paid out from the reel 9, the eversion aid 8 is permitted to descend as the everted portion of the liner 5 extends continuously deeper into the borehole 1 by the process of eversion at the descending eversion point 10. The diagrammatic arrows in FIG. 1 show the direction of travel of the inverted liner 11 as it passes through the eversion aid 8 and then everts at the moving eversion point 10. As the liner is drawn from the reel 9, a modest amount of water is added to the interior of the liner 5 via the top pipe 12. This added water causes' the everting liner 5 to dilate slightly, promoting the free travel of the inverted liner 11 from the reel 9 and into the interior of the everted portion of liner 5. The eversion aid 8 thus drives the eversion point 10 of the liner toward the bottom of the borehole 1 with very little borehole water fill being displaced radially into the surrounding media 2. With a generally cylindrical eversion aid 8 as described elsewhere herein, as the aid 8 moves down the borehole under its own weight, the inverted portion 11 of the liner moves downward, in relation to the aid, through the eversion aid interior, while the everted portion of the liner moves at substantially the same rate upward (again, relative to the aid) and past its exterior.

Figure 3:
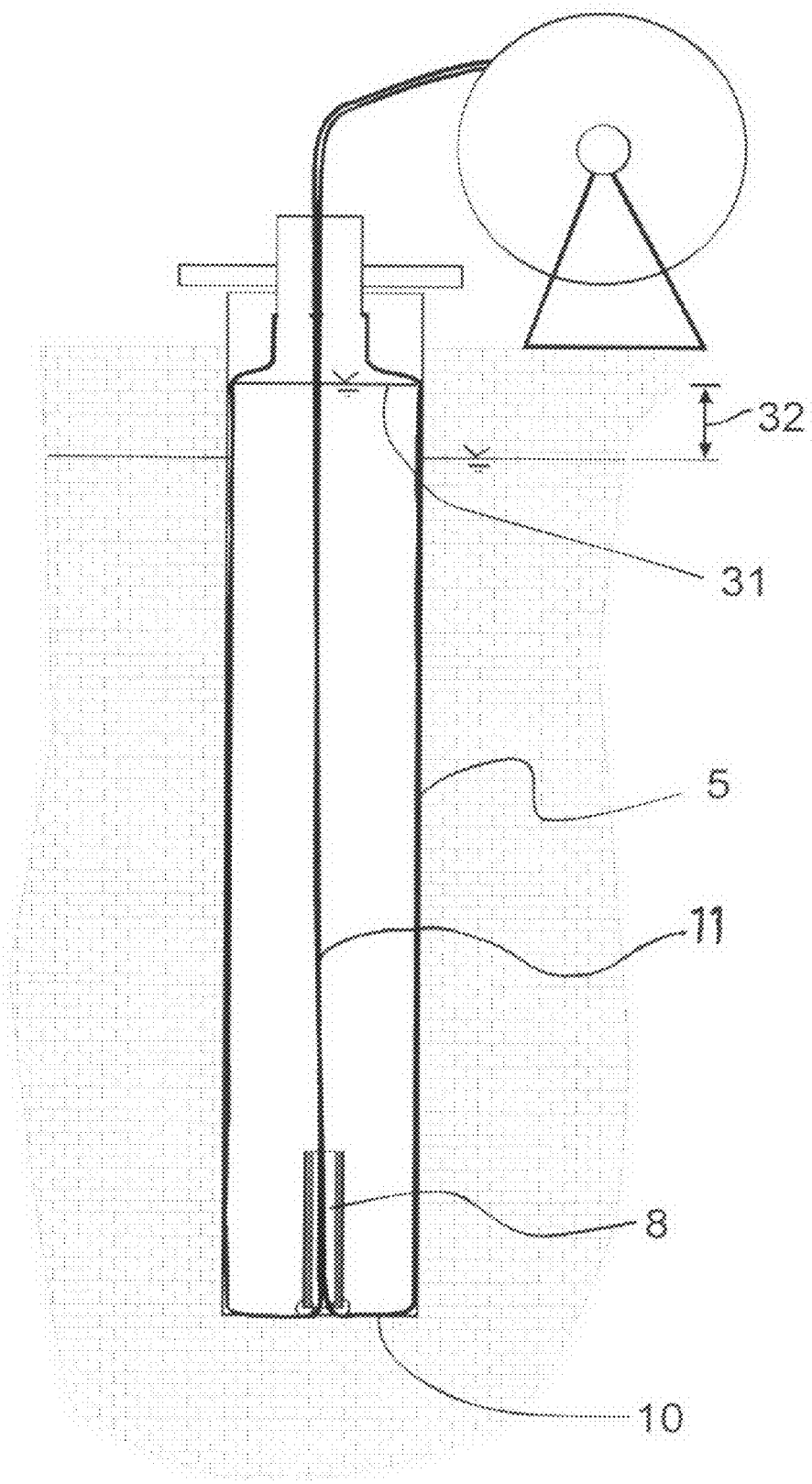
FIG. 3 is a cross-sectional side view diagram showing the fully dilated liner with excess head inside the liner.

The eversion aid 8 drives the liner eversion point 10 to the desired elevation within the borehole (nearly always the borehole's bottom end) as seen in FIG. 2. A first tube 21 is then installed from the ground surface to near the bottom of the interior of the liner 5. As also seen in FIG. 2, a second tube 22 is disposed into the annulus between the everted liner 5 and the surrounding formation 2, with its distal end situated beneath the water table 4 in the borehole 1. The respective proximate ends (above the water table) of both the first tube 21 and the second tube 22 are connected to, or otherwise in fluid communication with, a suitable commercially available pump 23. The pump 23 pumps water from the borehole 1 to the interior of the everted liner 5. As indicated by the directional arrows of FIG. 2 water from inside the borehole 1 (but outside the liner 5) is transferred via the first tube 22, pump 23, and first tube 21, into the interior of the liner 5. The water added through the first tube 21 to the liner interior causes the liner 5 to dilate first near its lowermost end, is indicated in FIG. 2. As water is further transferred, continued dilation of the liner 5 urges upward the water between the liner 5 and the surrounding formation 2, toward the bottom inlet of the second tube 22. This process is continued until substantially all the borehole water is transferred into the liner interior, as seen in FIG. 3, and, preferably, the interior water level 31 within the liner 5 rises a selected distance 32 above the original borehole water level 4, as indicated in FIG. 3. Operation of the pump 23 is discontinued, at which time the liner 5 is substantially fully dilated by the excess pressure head (i.e., resulting from the relatively elevated interior water level 31) and also urged against the interior of the borehole 1—sealing the formation 2 against flow into or out of the borehole.

As indicated in FIG. 3, the eversion aid 8 is within the liner 5 and at the eversion point, and rests on the bottom of the borehole hole 1. At this time, the borehole 1 is sealed, according to an object of the apparatus and method. Nearly all of the borehole water is stored inside the liner, and very little of the water has moved into the formation 2. Water preferably is transferred to a level 31 a height distance 32 above the water table 4. Such an installation procedure is not affected by the rate at which water can be displaced into the formation 2 (e.g., the formation's permeability or conductivity), but only by the rate that water can be pumped by the pump 23. By selecting an appropriate pump, that time to seal the borehole potentially can be less than thirty minutes. In case of a deep water table, the pump 23 preferably is located in the hole 1 at or near the bottom or distal end of the second tube 22.

Figure 4:
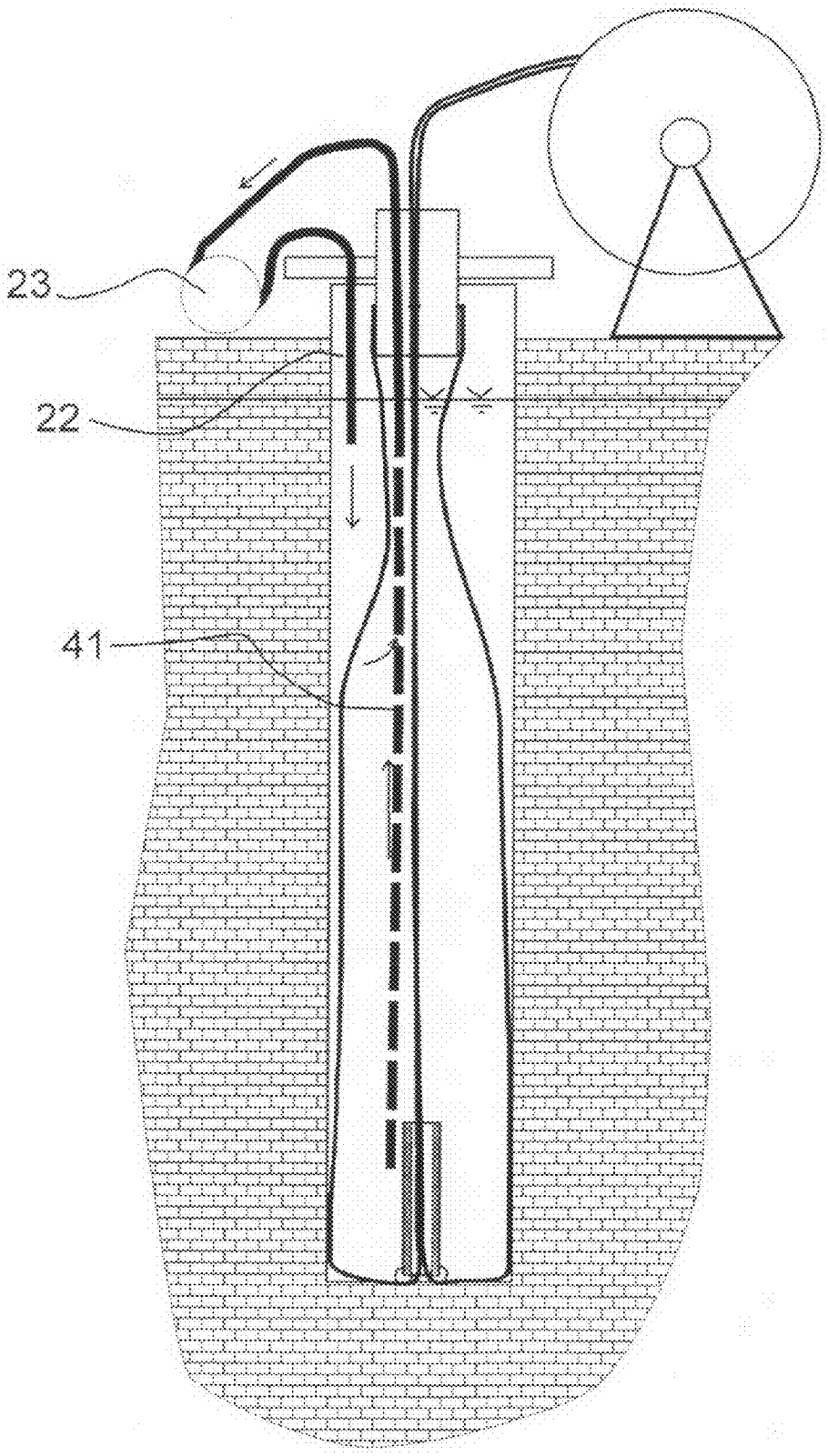
FIG. 4 is a cross-sectional side view diagram showing a perforated tube in place for removal of water from the liner, to permit its rapid withdrawal from the borehole, as according to the present disclosure.

The rapid removal of the liner is described with additional reference to FIG. 4. To accomplish a rapid removal or extraction, the first tube 21 is replaced with a partially perforated tube 41. The first tube 21 can be withdrawn and the perforated tube 41 provided in its place; alternatively, it may be possible and desirable to have both tubes 21 and 41 in place within the liner and down-hole throughout the duration of the procedure, and simply select (by suitable switch valves or the like) which of the two tubes (21 or 41) is operatively connected to the pump 23 (for flow to/from the pump) at a particular time. With the perforate tube 41 in place within the liner 5 as shown in FIG. 4, the pump direction is reversed on the pump 23 and the water is drawn from the interior of the liner 5 via the perforate tube 41. From within the liner interior, the water is transferred into the annulus space (between the formation 2 and the liner exterior) via the second tube 22. The perforated segment(s) of the tube 41 do not extend above (higher) than a pre-selected elevation a distance significantly below (e.g., approximately 10 feet below) the level of the water table 4 in the formation 2. The apertures in the perforated tube 41 cause the water in the tube to be drawn (by the action of the pump) preferentially from the upper reaches of the perforated tube, and thus an upper portion of the liner interior (in upper reaches of the borehole 1), causing the liner 5 to collapse first about the upper or proximate end of the tube 41. The collapsing liner 5 thus seals the upper perforations in the tube 41 (as the liner comes into sealing contact with the tube 41 along an increasingly longer portion of its length), causing the water to be drawn from progressively deeper in the liner 5. With continued pumping, the liner collapses against the tube 41 progressively downward toward the borehole bottom.

The pumping geometry thus causes the liner 5 to collapse progressively from the top or upper/proximate portions downward toward the borehole bottom, preferably until most of the water has been removed from the liner 5. While the water is being pumped from the liner, tension as applied to the inverted portion 11 of liner above the top pipe 6. Such tension is regulated to tend to lift the liner 5 from the borehole 1, thus allowing it to be re-wound upon the reel 9. Normally, a collapsed liner under this lifting tension would tend to buckle the liner at the bottom end of the borehole 1. However, the comparatively heavy eversion aid 8 defines an upwardly movable inversion point (which previously was the point of eversion during liner descent), and the weight of the eversion aid 8 causes the retracting liner 5 to invert back through the interior of the eversion aid 8 as the liner rises toward the surface onto the reel 9. Accordingly, as the liner is withdrawn from the borehole, the former eversion point 10 effectively becomes an "inversion point" that ascends the borehole 1. The eversion aid 8 "rides" the inversion point up the hole toward the surface, as the liner slides past the eversion aid. With a generally cylindrical eversion aid 8 as described elsewhere herein, as the aid 8 moves up the borehole, the inverted portion 11 of the liner moves upward, in relation to the aid, through the eversion aid interior, while the everted portion of the liner moves at substantially the same rate downward relative to the aid and past its exterior.

It is preferable that the liner tension above the pipe 6 be applied by hand in order to control the applied tension with some sense of when the liner 5 is re-inverting. A concern is that portions of the liner will collapse completely onto the inverted inner portions portion, causing a large drag/friction which would cause the inverted and everted portion of the liner to rise together. The inner (inverted) liner 11, preferably is free to rise inside the everted 5 length of the liner. To assure that there is no friction, a measured amount of water can be pumped back into the liner 5 from the borehole through the perforated tube 41, so as to slightly dilate the everted portion 5 of the liner. Further the eversion aid 8 preferably should be sufficiently heavy that there is a measurable difference between the tension needed to invert the liner through the eversion aid and to lift the eversion aid without inversion. The inversion tension applied to the liner 11 is, by preferable example, approximately half the tension force needed to lift the entire weight of the eversion aid 8.

Figure 5:
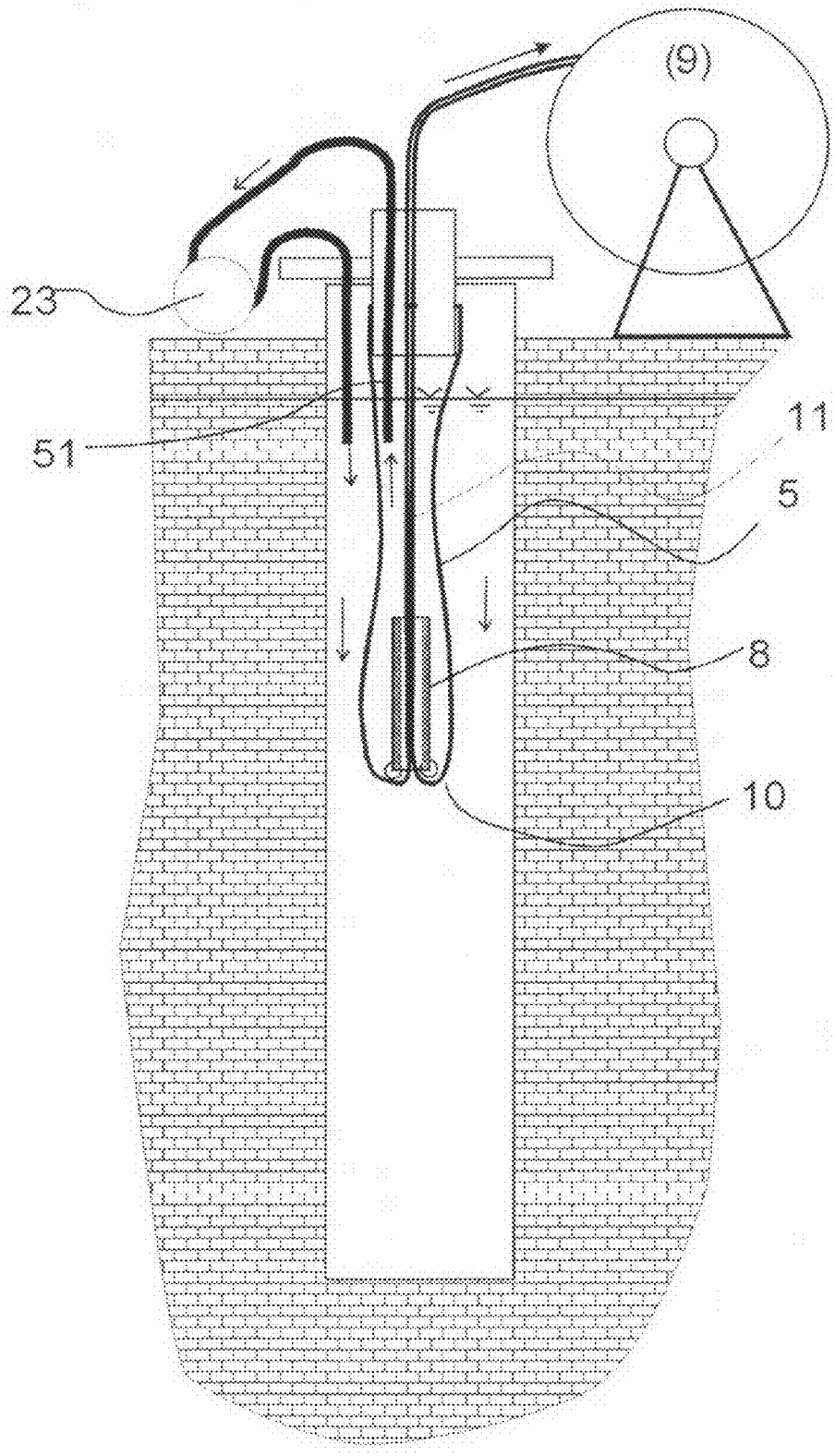
FIG. 5 is a cross-sectional side view diagram showing the liner being removed from a borehole with the help of the eversion aid and pump.

Reference is invited to FIG. 5. As the re-inversion of the liner occurs at the eversion point 10, the perforated tube 41 is replaced with a third, relatively short, tube 51 which removes water only from the top end of the collapsed liner. As the liner interior volume is reduced by the inversion, the water tends to rise in the liner 5 to this pump tube 51, which pumps the water into the borehole.

The sealing liner thus can be rapidly installed and removed as described one objective of the overall invention.

DETAILS OF A PREFERRED EMBODIMENT OF THE EVERSION AID COMPONENT

The eversion aid preferably is constructed and configured to perform its function in the confined space of the interior of the liner without damaging the liner. The eversion aid component preferably features the following characteristics:

1. Heavy (for example, 10 pounds or more, but depending on hole depth and diameter).
2. Compact (particularly in diameter vis-à-vis the diameter of the borehole), to not interfere with the liner's motion of eversion and to maintain a substantial downward force while under water.
3. Very low friction at both the top and bottom edges, to allow easy passage of the liner through the component.
4. Soft on the top and bottom edge to prevent damage to the liner when the eversion aid strikes the edge of a borehole enlargement.
5. Composed of environmentally innocuous materials that would not be a concern if the eversion aid component were accidentally lost in the hole.

Hypothetically, an otherwise ideal eversion aid would be a measured volume of mercury metal. It has the high density, low rigidity and moves easily with the liner. However, due to its high toxicity, of course, mercury is not an option for use in subsurface boreholes into the Earth. Therefore, a general design has been developed and tested for this application and works well.

Figure 6:
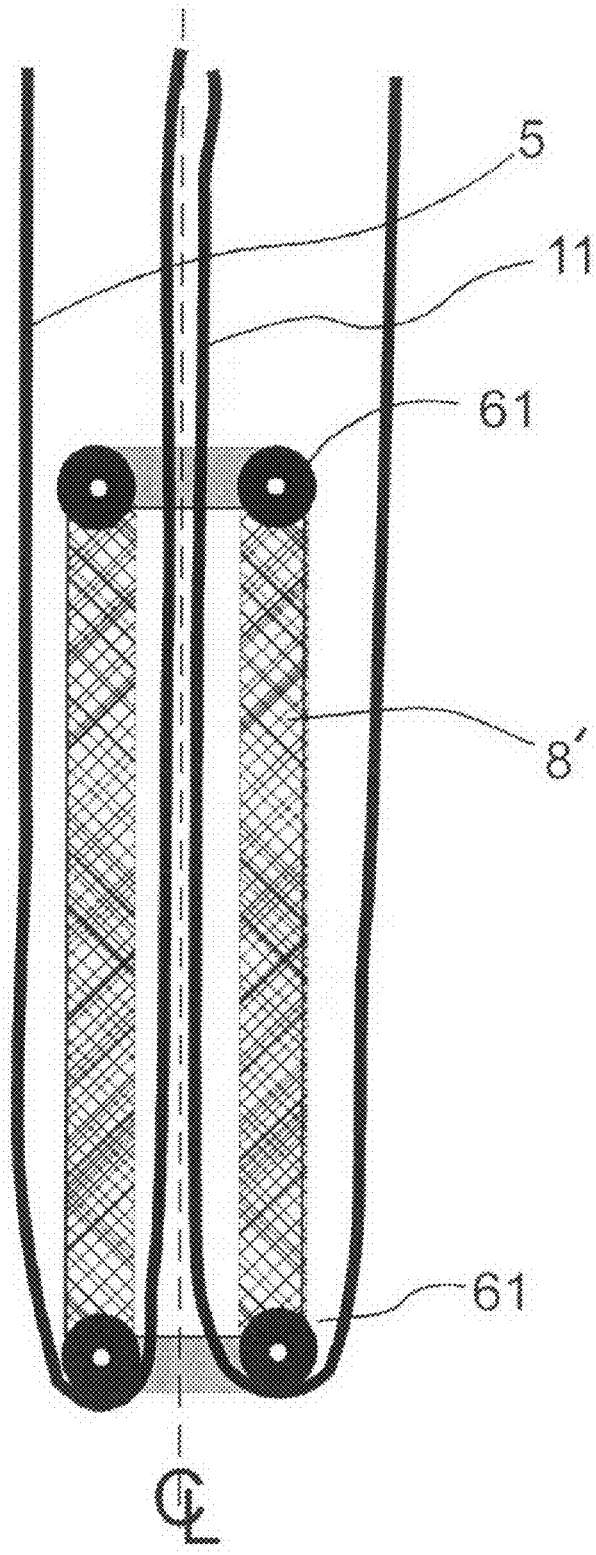
FIG. 6 is an enlarged cross-sectional side view diagram showing the features of a preferred embodiment of the eversion aid.

One preferred embodiment of the eversion aid is depicted in FIG. 6. The simple design is a metal cylinder 8' with pluralities of soft rubber rollers 61 rotatably attached to at least the bottom edge, but preferably at both the bottom and the top edges of the cylinder 8'. The rollers 61 facilitate the smooth movement of the liner (at the eversion point where it is folded back around the cylinder bottom) past the cylinder's bottom edge as the liner moves past the edge while the eversion aid moves up or down the borehole. The rollers 61 are preferably inset into individual recesses defined within the terminal edges of the cylinder. The roller axles are attached to the edges of the cylinder 8' as shown in cross section in FIG. 6. The rollers 61 preferably are positioned with a very small gap space between circumferentially adjacent individual rollers, to reduce the possibility of the liner becoming trapped between rollers.

Figure 7:
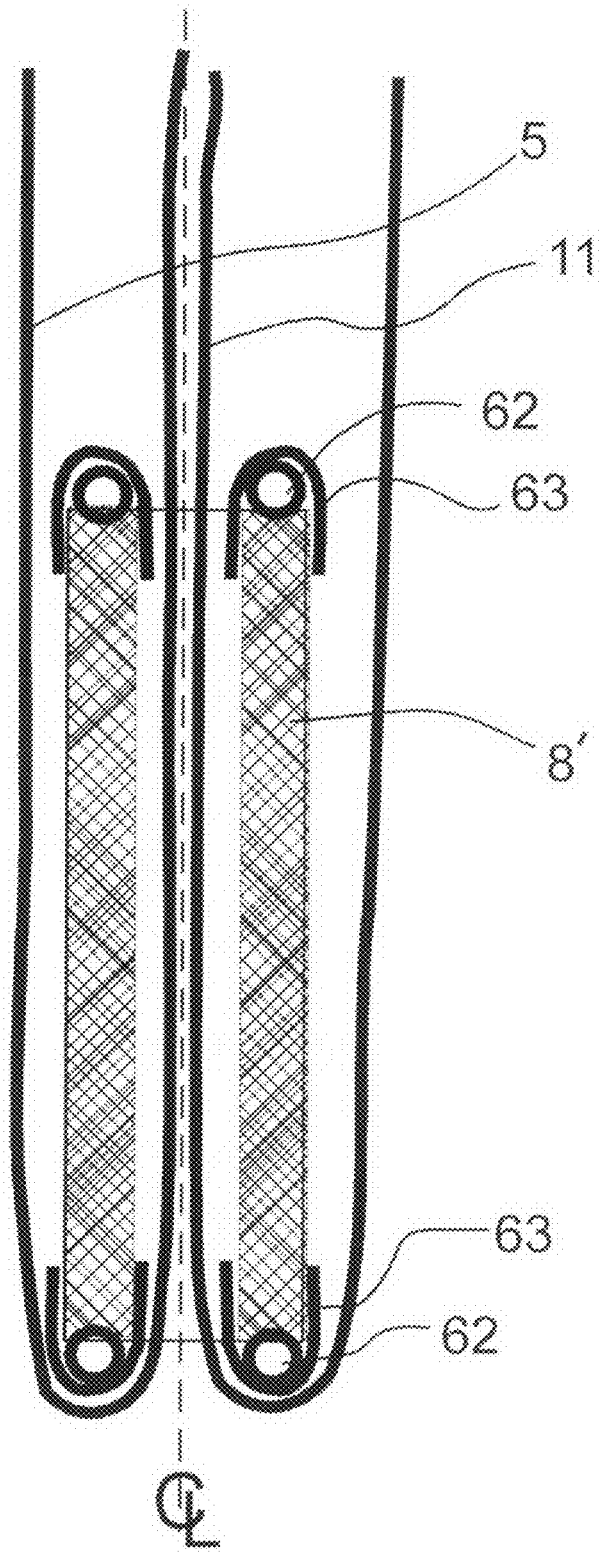
FIG. 7 is an enlarged cross-sectional side view diagram showing the features of an alternative desirable embodiment of the eversion aid.

A variation on the roller design, seen in FIG. 7, is to replace the roller assembly with a forgiving, but resilient, soft rubber (or suitable man-made polymer) edge component 62 disposed along the circumference of at least the bottom (distal) edge of the cylinder 8', but preferably along both terminal edges of the cylinder 8'. The rounded, generally annular edge component 62 facilitates the smooth sliding movement of the liner (at the eversion point where it is folded back around the cylinder bottom) as the liner slides around the edge while the eversion aid moves up or down the borehole. The gently rounded edge component 62 preferably is overlain by a sheet or layer of Teflon® material 63, or suitably equivalent other material having a similarly low coefficient of friction, which may be attached to the inside and the outside of the cylinder. This low-friction edge component 62 allows the liner 5 to slide easily past the edges of the eversion aide as it everts/inverts through the interior of the cylinder 8'.

An alternative embodiment of the eversion aid, shown in FIG. 8, includes a flexible cylinder 81 with a plurality of mildly flexible but weighty metal strips 82 secured longitudinally thereto to provide necessary additional weight. The cylinder 81 is composed of a durable, mostly inert but flexibly resilient material which can bow elastically inward or outward under either laterally or axially imposed tension or compression forces. A plurality of rollers 83 are rotatably mounted to the bottom ends of respective ones of the weighty metal strips 82. This alternative embodiment of eversion aid allows the volume of the interior space defined within the eversion aid to adapt, by radial contraction or expansion of the cylinder 8', as needed for liner passage.

Yet another alternative embodiment of eversion aid is illustrated in FIG. 9. A lightweight bell-shaped cylinder 73 is attached to the distal (bottom) end of a rigid everter pipe 72 that extends to the surface. The rigid pipe 72 can be controllably lowered to provide the downward force, as needed, to cause eversion of the liner. The shaped cylinder pushes the eversion point down, as the everted portion of the liner slides past the exterior of the everter pipe and the inverted portion of the liner moves through the interior of the everter pipe 72. The everter pipe 72 may be a flush-joint PVC pipe, which can also serves the water-addition purpose with, or in lieu of, the first tube 21 described above. The pipe 72 is serially assembled of threaded 71 segments as the eversion aid descends. The bottom distal edge of the shaped cylinder 74 may have rollers or a padded low friction edge, also as previously described above.

A useful variation on the overall design according to this disclosure is possible if the borehole depth is reliably known in advance of the liner installation procedure. In this alternative embodiment, both the first water addition tube 21 and the third, perforated water removal tube 41 are attached to the eversion aid 8. This embodiment permits the tubes to be installed conveniently into the liner 5 as the eversion aid 8 descends inside the liner. With both tubes 21 and 41 attached to the eversion aid 8, the aid pulls the tubes downward, and the water can be added to the interior liner, at its eversion point 10, during the descent. Similarly, water can be removed from the liner interior while withdrawing the liner 5, 11, from the hole. If the liner is to be left in place, the eversion aid 8 can be lifted from the interior of the liner by its attachment to the tubes 21, 41.

The method for rapidly everting a sealing liner down a borehole is evident from the foregoing, but is succinctly characterized. One preferred method includes the steps of everting the distal portion of the tubular liner about a movable eversion point to define an everted portion of the liner and an inverted portion of the liner, holding the distal, everted end of the liner at a position at or near the top of the borehole, disposing the eversion aid between the inverted portion of the liner and the everted portion of the liner near the eversion point, and then allowing the eversion aid to move down the borehole past the inverted and everted portions of the liner to move the eversion point toward the borehole bottom. (FIG. 1.) Preferably, the everted portion of the liner is controllably dilated to urge it radially outward within the borehole. (FIG. 2.) The step of dilating includes transferring water from within that portion of the borehole exterior to the liner, to the interior of the everted portion of the liner. (FIG. 2.) "Dilating" also includes, in the preferred process, progressively dilating the liner from the borehole bottom toward the borehole top. (FIGS. 2 and 3.) The water transferring process may include the steps of disposing the first tube into the interior of the everted portion of the liner, providing a second tube into the borehole between the liner and a borehole wall, and pumping water to the interior of the liner via the first and second tubes. (FIG. 2.) The sealing liner after full rapid installation is seen in FIG. 3.

The method of this disclosure also may include the further basic step of withdrawing the liner from the borehole by retracting upward under tension the inverted portion of the liner. To accomplish this, the eversion aid is lifted up the borehole, slidably past the inverted and everted portions of the liner, to move the liner inversion point toward the borehole top. While withdrawal of the liner is undertaken, steps are taken to induce the collapse of the everted portion of the liner to urge it radially inward within the borehole. Inducing this collapse preferably includes the step of transferring water from the interior of the everted portion of the liner to that portion of the borehole exterior to the liner. (FIG. 4.)

Withdrawing the liner while inducing its collapse preferably includes disposing a third, perforated tube into the interior of the everted portion of the liner, and pumping water via the perforated tube from within the interior of the everted portion of the liner to the borehole outside the liner. So, "inducing collapse" preferably includes progressively collapsing the liner, against the perforated tube, from an upper portion of the borehole toward the borehole bottom. (FIG. 4.)

Providing an eversion aid preferably means movably engaging an open-ended cylinder with the liner, as generally indicated in FIGS. 1-4. Movably engaging the cylindrical eversion aid with the liner preferably includes disposing the inverted portion of the liner through the interior of the cylinder, folding the liner around a bottom edge of the cylinder at the eversion point, and disposing the everted portion of the liner around the exterior of the cylinder, also as shown generally in FIGS. 1-4. Allowing the eversion aid to move down the borehole includes allowing the eversion aid to move, under its weight, down the borehole while the inverted portion of the liner moves through the interior of the eversion aid cylinder and everted portion of the liner moves past the exterior of the cylinder.

Preferably, smooth movement of the liner around and past the bottom edge of the cylinder is facilitated where the liner is folded at the eversion point. One possible mode of facilitating this smooth movement is to provide a plurality of rollers on the bottom edge of the eversion aid cylinder. (FIGS. 6 and 8.) Or, facilitating a sliding movement could include securing a resilient, rounded edge component along the circumference of at least the bottom edge of the eversion aid's cylinder. (FIG. 7) This rounded edge component may also be provided with a low-friction layer upon the edge component. (FIG. 7)

A variety of different open-ended cylinders could be provided for the eversion aid. A flexibly resilient cylinder may be supplied, with a plurality of metal strips, preferably somewhat bendable, secured longitudinally thereon for added weight and structural stability. (FIG. 8.)

Or, "disposing an eversion aid" may include attaching a cylinder to a bottom end of a rigid everter pipe, disposing the inverted portion of the liner through the interiors of the cylinder and everter pipe, disposing the everted portion of the liner around the exteriors of the cylinder and everter pipe, and lowering the everter pipe down the borehole to push the eversion point downward as the everted portion of the liner slides past the exterior of the everter pipe and the inverted portion of the liner moves through the interior of the everter pipe. A system for this process is seen in FIG. 9.

In summary, the disclosed apparatus and method incorporates an eversion aid with a flexible liner, and an installation and removal procedure to obtain the rapid installation and rapid removal of a flexible liner for the described or any other utilitarian purpose. A major advantage of the disclosed apparatus is that it can be shipped to the drill site in a very compact form on a shipping reel which is used for the emplacement.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

I claim:

1. A method for rapidly everting a sealing liner down a borehole, comprising the steps of:

everting a distal portion of a tubular liner about a movable eversion point to define an everted portion of the liner and an inverted portion of the liner;

holding a distal, everted end of the liner at a position at or near the top of the borehole;

disposing an eversion aid apparatus between the inverted portion of the liner and the everted portion of the liner, near the eversion point; and allowing the eversion aid apparatus to move down the borehole past the everted portion of the liner to move the eversion point toward the borehole bottom.

2. The method of claim 1 further comprising the step of dilating the everted portion of the liner to urge it radially outward within the borehole.

3. The method of claim 2 wherein dilating comprises the step of transferring water from within the borehole, exterior to the liner, to the interior of the everted portion of the liner.

4. The method of claim 3 wherein the step of dilating comprises progressively dilating the liner from the borehole bottom toward the borehole top.

5. The method of claim 3 wherein transferring comprises the steps of:

disposing a first tube into the interior of the everted portion of the liner;

providing a second tube into the borehole between the liner and a borehole wall; and pumping water to the interior of the liner via the first and second tubes.

6. The method of claim 1 further comprising the step of withdrawing the liner from the borehole by retracting upward under tension the inverted portion of the liner.

7. The method of claim 6 comprising the further step of lifting the eversion aid apparatus up the borehole, slidably past the inverted and everted portions of the liner, to move a liner inversion point toward the borehole top.

8. The method of claim 6 further comprising the step of inducing the collapse of the everted portion of the liner to urge it radially inward within the borehole.

9. The method of claim 8 wherein inducing collapse comprises the step of transferring water from the interior of the everted portion of the liner to the borehole, exterior to the liner.

10. The method of claim 9 comprising the further steps of:

disposing a third, perforated tube into the interior of the everted portion of the liner; and pumping water via the perforated tube from within the interior of the everted portion of the liner to the borehole, exterior to the liner.

11. The method of claim 10 wherein the step of inducing collapse comprises progressively collapsing the liner, against the perforated tube, from an upper portion of the borehole toward the borehole bottom.

12. The method of claim 6 wherein disposing an eversion aid apparatus comprises:

attaching a cylinder to a bottom end of a rigid everter pipe;

disposing the inverted portion of the liner through the interiors of the cylinder and everter pipe;

disposing the everted portion of the liner around the exteriors of the cylinder and everter pipe; and lowering the everter pipe down the borehole to push the eversion point downward as the everted portion of the liner slides past the exterior of the everter pipe and the inverted portion of the liner moves through the interior of the everter pipe.

13. The method of claim 1 wherein disposing an eversion aid apparatus comprises movably engaging an open-ended cylinder with the liner.

14. The method of claim 13 wherein the step of movably engaging comprises:

disposing the inverted portion of the liner through the interior of the cylinder;

folding the liner around a bottom edge of the cylinder at the eversion point; and disposing the everted portion of the liner around the exterior of the cylinder.

15. The method of claim 14 wherein the step of allowing the eversion aid apparatus to move down the borehole comprises allowing the eversion aid apparatus to move under its weight down the borehole while the inverted portion of the liner moves through the interior of the cylinder and the everted portion of the liner moves past the exterior of the cylinder.

16. The method of claim 15 comprising the further step of facilitating smooth movement of the liner around and past the bottom edge of the cylinder where the liner is folded at the eversion point.

17. The method of claim 16 wherein the step of facilitating comprises providing a plurality of rollers on the bottom edge of the cylinder.

18. A method according to claim 16 wherein the step of facilitating comprises securing a resilient, rounded edge component along the circumference of at least the bottom edge of the cylinder.

19. A method according to claim 18 wherein the step of facilitating further comprises providing a low-friction layer upon the edge component.

20. The method of claim 13 wherein providing an open-ended cylinder comprises providing a flexibly resilient cylinder and securing longitudinally thereon a plurality of flexible metal strips.

* * * * *